US007391428B2

(12) United States Patent
Lee

(10) Patent No.: US 7,391,428 B2
(45) Date of Patent: Jun. 24, 2008

(54) THERMAL IMAGE FORMING APPARATUS

(75) Inventor: Yong-duk Lee, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 346 days.

(21) Appl. No.: 11/235,242

(22) Filed: Sep. 27, 2005

(65) Prior Publication Data

US 2006/0077250 A1 Apr. 13, 2006

(30) Foreign Application Priority Data

Oct. 9, 2004 (KR) ..... 10-2004-0080733

(51) Int. Cl.
*B41J 25/304* (2006.01)

(52) U.S. Cl. ..... 347/197

(58) Field of Classification Search ..... 347/197, 347/218; 400/120.16
See application file for complete search history.

(56) References Cited

U.S. PATENT DOCUMENTS

| | | | | |
|---|---|---|---|---|
| 7,179,002 | B2 * | 2/2007 | Lee et al. | 400/120.17 |
| 7,198,419 | B2 * | 4/2007 | Lee | 400/120.16 |
| 2003/0125206 | A1 | 7/2003 | Bhatt et al. | |
| 2006/0033802 | A1 * | 2/2006 | Park | 347/187 |
| 2006/0061648 | A1 * | 3/2006 | Lee et al. | 347/171 |
| 2006/0061649 | A1 * | 3/2006 | Lee | 347/215 |
| 2006/0092260 | A1 * | 5/2006 | Min | 347/209 |
| 2006/0115311 | A1 * | 6/2006 | Son et al. | 400/120.17 |

FOREIGN PATENT DOCUMENTS

| | | | |
|---|---|---|---|
| JP | 59-71226 | 5/1984 | |
| JP | 60-4-341 | 3/1985 | |
| JP | 61-267624 | 11/1986 | |
| JP | 62-211228 | 9/1987 | |
| JP | 62-181533 | 11/1987 | |
| JP | 06-47970 | * 2/1994 | 347/218 |
| JP | 07-081177 | 3/1995 | |
| JP | 11-139605 | 5/1999 | |
| JP | 2001-071606 | 3/2001 | |
| JP | 2001-310503 | 11/2001 | |
| JP | 2002-051196 | 2/2002 | |
| JP | 2002-283635 | 10/2002 | |
| JP | 2002-075214 | 3/2004 | |

* cited by examiner

*Primary Examiner*—Huan H Tran
(74) *Attorney, Agent, or Firm*—Roylance, Abrams, Berdo & Goodman, L.L.P.

(57) ABSTRACT

A thermal image forming apparatus is provided. The thermal image forming apparatus includes an image forming unit including a thermal printhead and a platen that face each other and are elastically biased towards each other; a cassette including a knock-up plate on which a medium is stacked, a pickup roller that picks up the medium from the cassette, and a pickup unit that raises the knock-up plate in a direction in which the medium stacked on the knock-up plate contacts the pickup roller and lowers the knock-up plate in a direction in which the medium is separated from the pickup roller.

22 Claims, 12 Drawing Sheets

THERMAL IMAGE FORMING APPARATUS

CROSS-REFERENCE TO RELATED PATENT APPLICATIONS

This application claims the benefit under 35 U.S.C. § 119 (a) of Korean Patent Application No. 10-2004-0080733, filed on Oct. 9, 2004, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to a thermal image forming apparatus that prints an image by heating a medium.

2. Description of the Related Art

Conventional thermal image forming apparatuses generally use of two methods to form an image on both sides of a recording medium. In a first method, two thermal printheads (TPHs) that face each other are installed on first and second surfaces of the recording medium. This method is expensive because it uses two thermal printheads, which are expensive.

In a second method, one TPH is installed so that the TPH may face the first and second surfaces of the recording medium, in sequence. To do this, the TPH may be fixed in the image forming apparatus and the recording medium may be reversed. Alternatively, the TPH may move between positions that face the first and second surfaces of the recording medium, in sequence. Unfortunately, in conventional devices, the structure for performing this operation is complicated.

Accordingly, there is a need for a thermal image forming apparatus with an improved structure for printing on both sides of a recording medium.

SUMMARY OF THE INVENTION

An aspect of the present invention is to solve at least the above problems and/or disadvantages and to provide at least the advantages described below. Accordingly, an aspect of the present invention is to provide a thermal image forming apparatus for printing an image on both sides of a recording medium by installing one thermal printhead (TPH) and moving the TPH to first and second positions that face first and second surfaces of the recording medium.

In an exemplary embodiment of the invention, a thermal image forming apparatus comprises an image forming unit that includes a TPH and a platen that face each other and are elastically biased towards each other, a cassette that includes a knock-up plate on which a medium is stacked, a pickup roller that picks up the medium from the cassette and can be separated from the medium, and a pickup unit that raises the knock-up plate so that the medium stacked on the knock-up plate contacts the pickup roller and moves the knock-up plate in a direction in which the medium is separated from the pickup roller.

The apparatus may further include a TPH moving unit that moves the TPH to a contact position where the TPH contacts the platen, a first open position where the TPH is separated from the platen by a first gap, and a second open position where the TPH is separated from the platen by a second gap, wherein the pickup unit pushes the knock-up plate toward the pickup roller when the TPH is placed at the second open position.

The apparatus may further include a transfer unit placed between the pickup roller and the image forming unit. The transfer unit transfers the medium in a first direction for adjusting a printing start position when the TPH is placed at the first open position. The transfer unit also supplies the medium between the TPH and the platen, and transfers the medium in a second direction for printing when the TPH is placed at the contact position. The apparatus may further include a discharge unit that discharges the medium when the discharge unit is engaged with the pickup roller and driven.

The apparatus may further include a position converting unit that rotates the TPH around a rotating shaft of the platen between a first position that faces a first surface of the medium and a second position that faces a second surface opposite to the first surface.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1A:
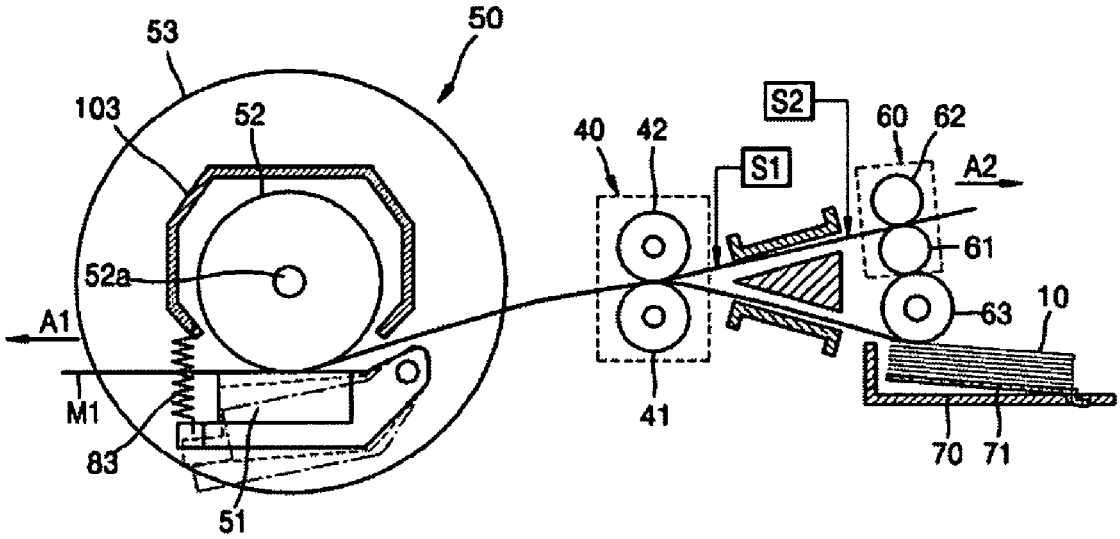
FIGS. 1A and 1B illustrate the structure of a thermal image forming apparatus according to an exemplary embodiment of the present invention.
Figure 1B:
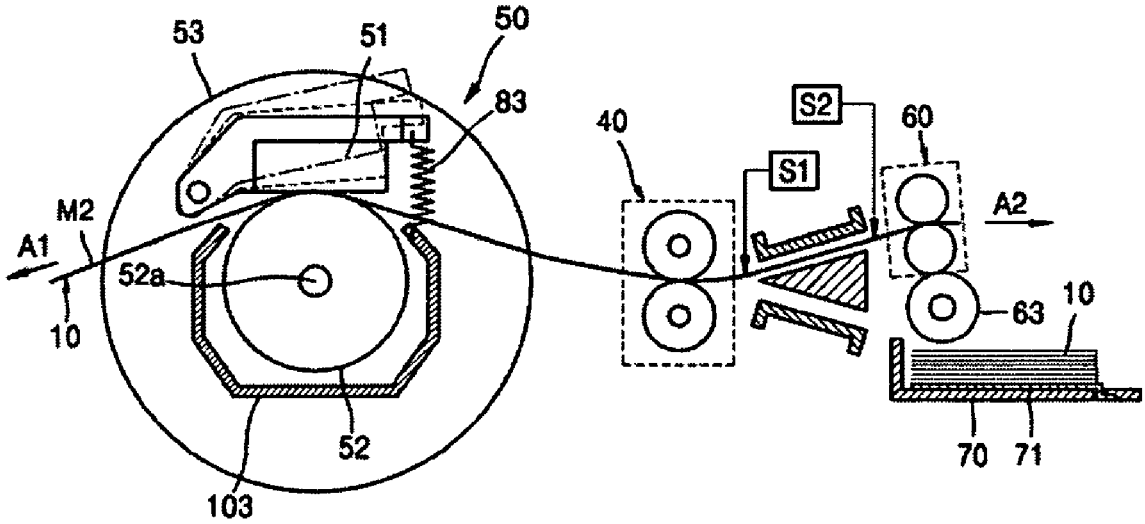

FIGS. 1A and 1B illustrate the structure of a thermal image forming apparatus according to an exemplary embodiment of the present invention. Referring to FIG. 1A, an image forming unit 50 includes a thermal printhead (TPH) 51 which forms an image by heating a medium 10, and a platen 52 which faces the TPH 51 and supports the medium 10. The TPH 51 and the platen 52 are elastically biased towards one another by an elastic member 83 so that they contact each other. A knock-up plate 71 is pivotably installed in a cassette 70. The medium 10 is stacked on the knock-up plate 71. A pickup roller 63 is disposed above the knock-up plate 71. The pickup roller 63 does not contact the medium 10 which is stacked on the knock-up plate 71 when the knock-up plate is lowered, as shown in FIG. 1B. When picking-up the medium 10, as shown in FIG. 1A, the knock-up plate 71 is rotated so that the pickup roller 63 contacts the medium 10.

A transfer unit 40 is placed between the image forming unit 50 and the pickup roller 63 and transfers the medium 10 in first and second directions A1 and A2. The transfer unit 40 includes a transfer roller 41 and an idle roller 42 engaged with the transfer roller 41 according to an exemplary embodiment of the present invention. A discharge unit 60 includes a discharge roller 61, which is engaged with the pickup roller 63, and an idle roller 62 that is engaged with the discharge roller 61, according to an exemplary embodiment of the present invention. With this arrangement, a simple structure can be used to connect a driving motor (not shown) to the discharge unit 60 and the pickup roller 63.

The medium 10 is picked up by the pickup roller 63 from the cassette 70 and transferred by the transfer unit 40 in the first direction A1. The medium 10 is transferred between the TPH 51 and the platen 52. When the medium 10 is placed at a printing start position, the transfer unit 40 starts transferring the medium 10 in the second direction A2. The TPH 51 prints an image on the medium 10 by heating the medium 10. The discharge unit 60 discharges the medium 10 on which the image is printed.

For double-sided printing, the TPH 51 may move between a first position (FIG. 1A) that faces a first surface M1 of the medium 10 and a second position (FIG. 1B) that faces a second, opposite surface M2 of the medium 10. For example, the TPH 51 may be rotated around a rotating shaft 52*a* of the platen 52 to move to the first and second positions. At the beginning of the printing process, the TPH 51 is placed at the first position. The medium 10 is picked up by the pickup roller 63 from the cassette 70 and transferred by the transfer unit 40 in the first direction A1. The medium 10 is transferred between the TPH 51 and the platen 52. The TPH faces the first surface M1 of the medium 10. When the medium 10 is placed at the printing start position, the transfer unit 40 starts transferring the medium 10 in the second direction A2. The TPH 51 prints an image by heating the first surface M1 of the medium 10. The discharge unit 60 temporarily discharges the medium 10 on which the image is printed on the first surface M1. When printing on the first surface M1 of the medium 10 is completed, the transfer unit 40 and the discharge unit 60 stop. At this stage of printing, the medium 10 is located between the transfer unit 40 and the discharge unit 60, and does not pass between the TPH 51 and the platen 52. The TPH 51 moves to the second position, as shown in FIG. 1B. The transfer unit 40 and the discharge unit 60 transfer the medium 10 in the first direction A1 again. The medium 10 is transferred between the TPH 51 and the platen 52. The TPH 51 faces the second surface M2 of the medium 10. When the medium 10 is placed at the printing start position, the transfer unit 40 starts transferring the medium 10 in the second direction A2 again. The TPH 51 prints an image by heating the second surface M2 of the medium 10. The discharge unit 60 discharges the medium 10 which has images printed on both sides.

The image forming apparatus according to the present exemplary embodiment includes a position converting unit which rotates the TPH 51 around a rotating shaft 52*a* of the platen 52, for example, and moves the TPH 51 to the first and second positions.

The image forming apparatus according to the present exemplary embodiment further includes a TPH moving unit which moves the TPH 51 between a contact position, a first open position, and a second open position. In the contact position (the position marked by solid lines in FIGS. 1A and 1B), the TPH contacts the platen 52. In the first open position (the position marked by dotted lines in FIGS. 1A and 1B), the TPH is separated from the platen 52 by a first gap. In the second open position (the position marked by phantom lines in FIGS. 1A and 1B), the TPH is separated from the platen 52 by a second gap. When the transfer unit 40 transfers the medium 10 in the second direction A2, the TPH 51 is placed at the contact position. When the transfer unit 40 transfers the medium 10 in the first direction A1, the TPH 51 is placed at the first open position. When the pickup roller 63 picks up the medium 10 from the cassette 70, the TPH 51 is placed at the second open position.

The pickup roller 63 may be rotated only when the medium 10 is picked up. To this end, a clutch device which interrupts a driving force transmitted from a driving motor (not shown) to the pickup roller 63 is needed. However, such a clutch device is preferably not used with the image forming apparatus according to an exemplary embodiment of the present invention. This is because the discharge unit 60 is driven by the pickup roller 63, so when the driving force of the driving motor transferred to the pickup roller 63 is interrupted, the discharge unit 60 cannot be driven. In addition, since the discharge unit 60 transfers the medium 10 in the first and second directions A1 and A2, the pickup roller 63 should rotate both forward and backward. To do so, the image forming apparatus according to the present exemplary embodiment further includes a pickup unit which separates the knock-up plate 71 from the pickup roller 63 so that the pickup roller 63 does not contact the medium 10 stacked on the knock-up plate 71. The pickup unit also pushes the knock-up plate 71 toward the pickup roller 63 so that the pickup roller 63 contacts the medium 10 stacked on the knock-up plate 71 to pick up the medium 10. The pickup unit pushes the knock-up plate 71 toward the pickup roller 63 when the TPH 51 moves to the second open position.

Figure 2:
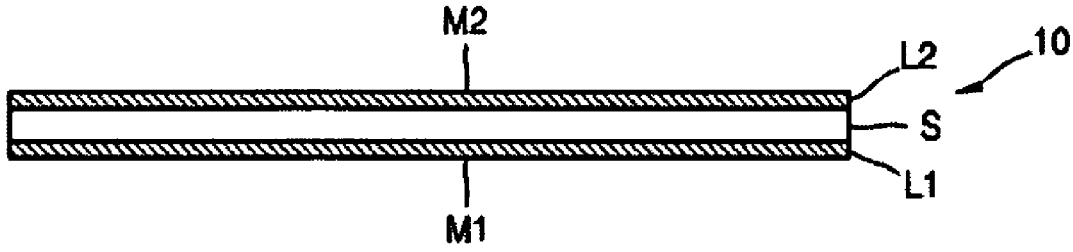
FIG. 2 is a cross-sectional view illustrating an example of a recording medium.

The medium 10 used in the image forming apparatus according to the present invention may have the structure shown in FIG. 2. Heat reactive ink layers L1 and L2 are located on both sides (that is, the first surface M1 and the second surface M2) of a base sheet S of the medium 10. Each of the ink layers L1 and L2 may have a single layer structure for producing a single color or a multi-layer structure for producing two or more colors. As a first example, two layers may be formed as the ink layer L1 for producing yellow and magenta colors, and one layer may be formed as the ink layer L2 for producing a cyan color. The yellow and magenta colors of the ink layer L1 may be selectively produced according to the temperature and heating time of the TPH 51. For example, when the ink layer L1 is heated at a high temperature for a short time, a yellow color may be produced, and when the ink layer L1 is heated at a low temperature for a long time, a magenta color may be produced. Of course, the opposite is also possible. When the base sheet S is made of a transparent material, and the ink layers L1 and L2 produce yellow, magenta, and cyan colors, the three colors overlap with one another and produce a full color image. One suitable medium 10 is disclosed in U.S. Patent Publication No. U.S. 2003/0125206, which is hereby incorporated by reference in its entirety.

As a second example, when the base sheet S is made of an opaque material, different images are printed on the first and second surfaces M1 and M2, thereby performing double-sided printing. The image forming method according to the present invention is not limited to any particular structure of ink layers.

Figure 3:
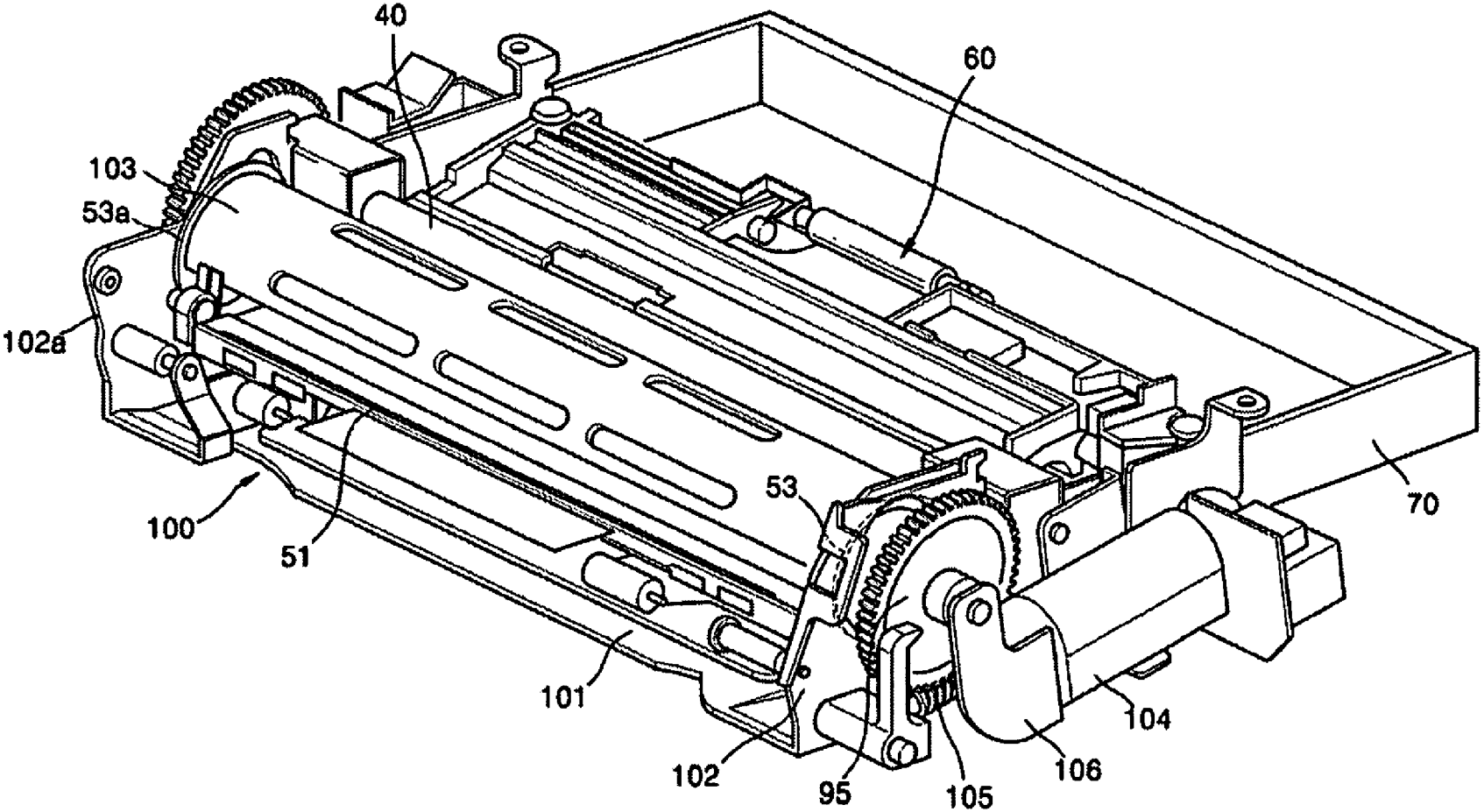
FIG. 3 is a perspective view of a thermal image forming apparatus according to another exemplary embodiment of the invention.
Figure 4:
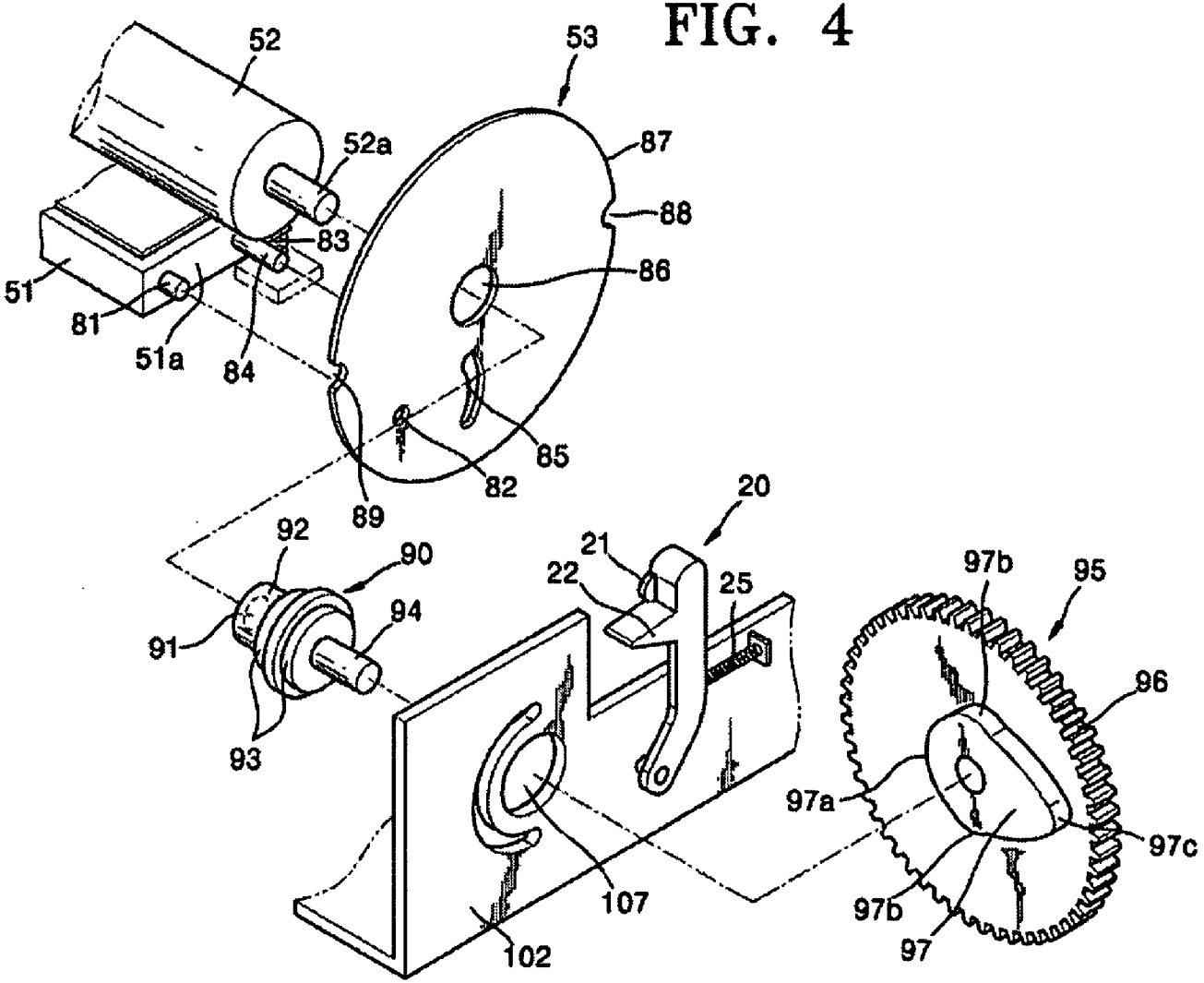
FIG. 4 is an exploded perspective view illustrating a position converting unit and a thermal printhead moving unit according to another exemplary embodiment of the present invention.

FIG. 3 is a schematic perspective view of a thermal image forming apparatus according to another exemplary embodiment of the present invention. FIG. 4 is an exploded perspective view of a position converting unit and a TPH moving unit according to another exemplary embodiment of the present invention.

Referring to FIGS. 3 and 4, a frame 100 includes a lower base 101 and two side plates 102 and 102*a* that stand substantially vertically on both sides of the lower base 101. The cassette 70 on which the medium 10 is stacked is installed at one side of the frame 100. The transfer unit 40, the discharge unit 60, and the pickup roller 63 shown in FIGS. 1A and 1B are supported by the two side plates 102 and 102*a* of the frame 100. The discharge unit 60 contacts the pickup roller 63 and is driven by a driving motor (not shown). The driving motor may be disposed on the side plate 102*a*.

Referring to FIG. 4, the TPH 51 is combined with a pair of support brackets 53 and 53*a*. A hinge shaft 81 formed at a portion 51*a* of the TPH 51 is inserted into a hinge hole 82 formed in the pair of support brackets 53 and 53*a*, respectively. The TPH 51 rotates around the hinge hole 82 into the contact position and the first and second open positions. The TPH 51 is elastically biased by the elastic member 83 towards the platen 52 so that it contacts the platen 52. As shown in FIGS. 1A and 1B, the elastic member 83 may be, for example, a tension coil spring with one end connected to the TPH 51 and another end connected to a cover 103 that surrounds the platen 52. The cover 103 is combined with the pair of support brackets 53 and 53*a*.

One end of a shaft 84 is combined with the TPH 51, and the other end is inserted into a through hole 85 formed in the support bracket 53. The through hole 85 may be elongated so that the TPH 51 can rotate between the contact position and the first and second open positions. In the present exemplary embodiment, since the TPH 51 is rotated around the hinge hole 82, the through hole 85 may have a circular arc shape around the hinge hole 82. The platen 52 according to the present invention is not connected to the driving motor. The platen 52 contacts the medium 10 and is rotated by the medium 10 as the medium 10 is transferred by the transfer unit 40. The platen 52 may be connected to the driving motor so that it is rotated by the driving motor.

A bushing 90 comprises an inner diameter portion 91 and first, second, and third outer diameter portions 92, 93, and 94, which are concentric with one another. The rotating shaft 52*a* of the platen 52 is inserted into the inner diameter portion 91. The first inner diameter portion 92 is rotatably inserted into a support hole 86 formed in the support bracket 53. A rotating cam 95 is rotatably combined with the third outer diameter portion 94. The rotating cam 95 comprises a gear portion 96 and a cam portion 97 for pushing the shaft 84. The cam portion 97 comprises first, second, and third cam parts 97*a*, 97*b*, and 97*c*, each corresponding to the contact position, and the first and second open positions of the TPH 5. A motor (104 of FIG. 3) comprises a worm gear 105 engaged with the gear portion 96. The motor 104 is mounted on a bracket 106 which is disposed on the side plate 102. The second outer diameter portion 93 of the bushing 90 is inserted into a hole 107 formed in the side plate 102, and an end of the third outer diameter portion 94 is supported by the bracket 106. The bracket 106 holds the rotating cam 95 together with the third outer portion 94. In the above structure, the platen 52, the support bracket 53, and the rotating cam 95 have the same axis of rotation. The support bracket 53 has a circular outer circumference 87, and first and second combination grooves 88 and 89, which are preferably separated from each other by approximately 180 degrees, are formed on the outer circumference 87. A locking member 20 is combined with the side plate 102. An elastic member 25 applies an elastic force to the locking member 20 in a direction where the locking member 20 is combined with the first and second combination grooves 88 and 89. The locking member 20 according to the present exemplary embodiment is released from the first and second combination grooves 88 and 89 by the rotating cam 95 and is combined with the first and second combination grooves 88 and 89 by the elastic force of the elastic member 25. The locking member 20 comprises a protrusion 21 combined with the first and second combination grooves 88 and 89 and an interference portion 22 that interferes with the cam portion 97 of the rotating cam 95.

Figure 5:
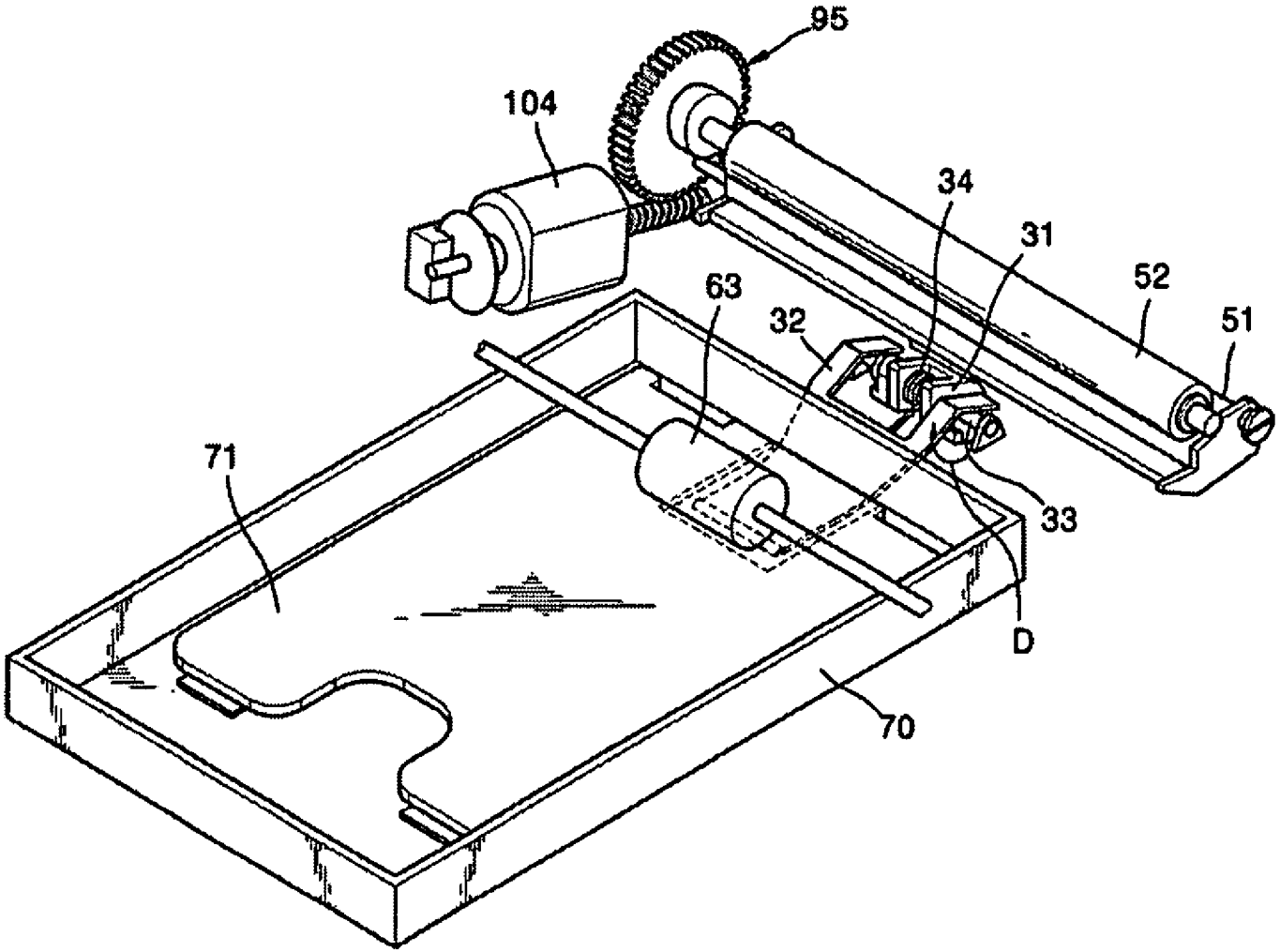
FIG. 5 is a perspective view illustrating a pickup unit according to an exemplary embodiment of the present invention.

FIG. 5 is an exploded perspective view of a pickup unit. Referring to FIG. 5, first and second arms 31 and 32 are rotatably installed on a shaft 33. The first arm 31 extends under the TPH 51. (See FIG. 6*a*) The second arm 32 extends under the knock-up plate 71. An elastic member (preferably, a torsion spring) 34 connects the first and second arms 31 and 32 to each other. One end of the torsion spring 34 is supported by the first arm 31, and the other end is supported by the second arm 32. While the TPH moving unit moves the TPH 51 from the contact position to the first open position, the first arm 31 does not contact the TPH 51. When the TPH 51 is rotated by the TPH moving unit into the second open position, the TPH 51 pushes the first arm 31. Then, the first arm 31, the torsion spring 34, and the second arm 32 are rotated in the direction of the arrow D in FIG. 5. The second arm 32 pushes the knock-up plate 71 toward the pickup roller 63. The medium 10 which is stacked on the knock-up plate 71 contacts the pickup roller 63. When the TPH 51 moves from the second open position to the first open position by the TPH moving unit, the first and second arms 31 and 32 and the torsion spring 34 are restored to their original positions by the weight of the knock-up plate 71 and weight of the medium 10 stacked on the knock-up plate 71.

FIGS. 6A through 6G illustrate the operations of a position converting unit, a TPH moving unit, and a pickup unit.

Figure 6A:
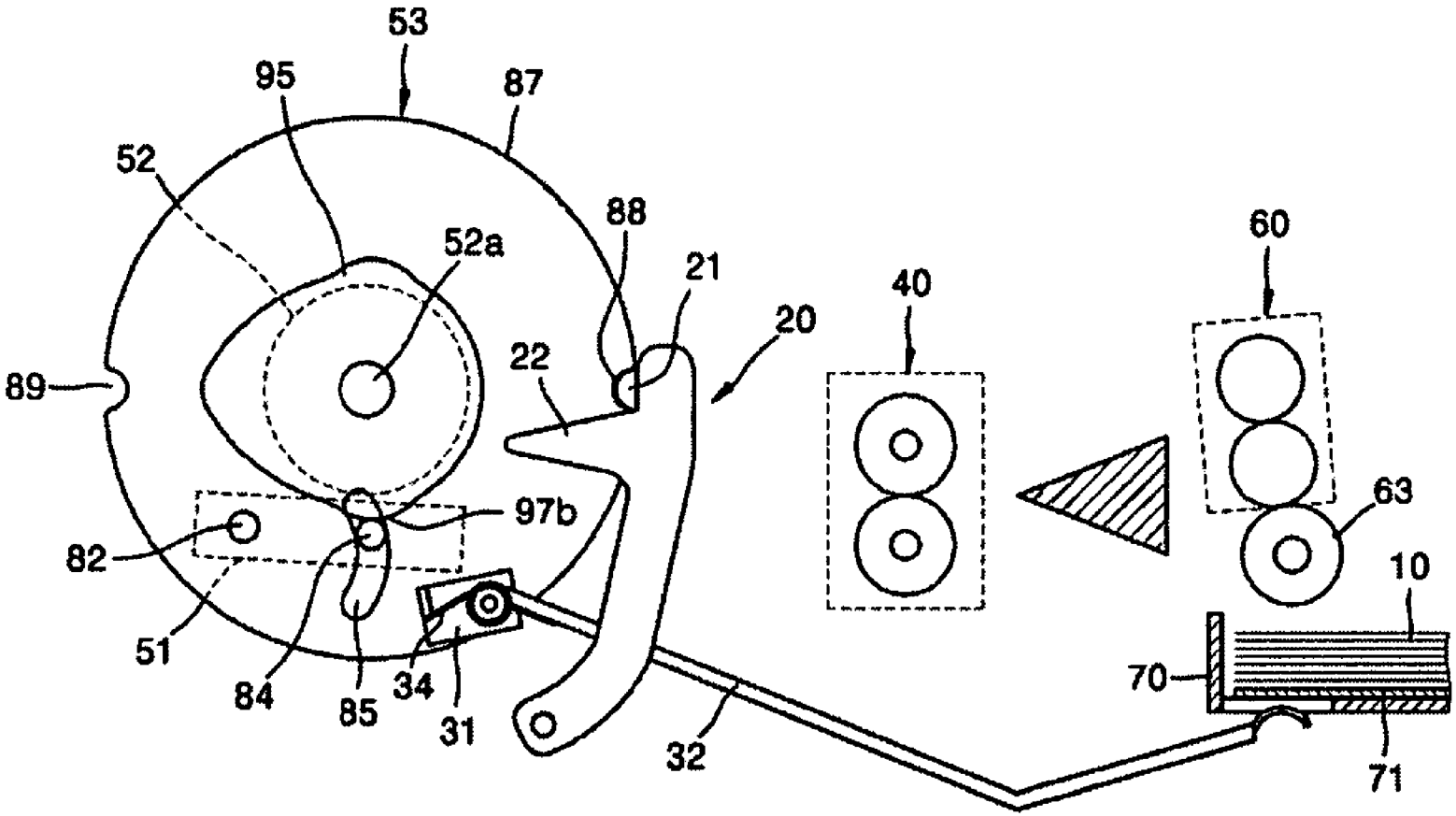
FIGS. 6A through 6G illustrate the operations of a position converting unit, a TPH moving unit, and a pickup unit according to an exemplary embodiment of the present invention.

Initially, as shown in FIG. 6A, the shaft 84 contacts the second cam part 97*b*. Thus, the TPH 51 is placed at the first open position separated from the platen 52 by the first gap. In addition, the protrusion 21 of the locking member 20 is located in the first combination groove 88, and the TPH 51 is locked at the first position. The first arm 21 is separated from the TPH 51. Since the knock-up plate 71 is lowered, the medium 10 is separated from the pickup roller 63.

Figure 6B:
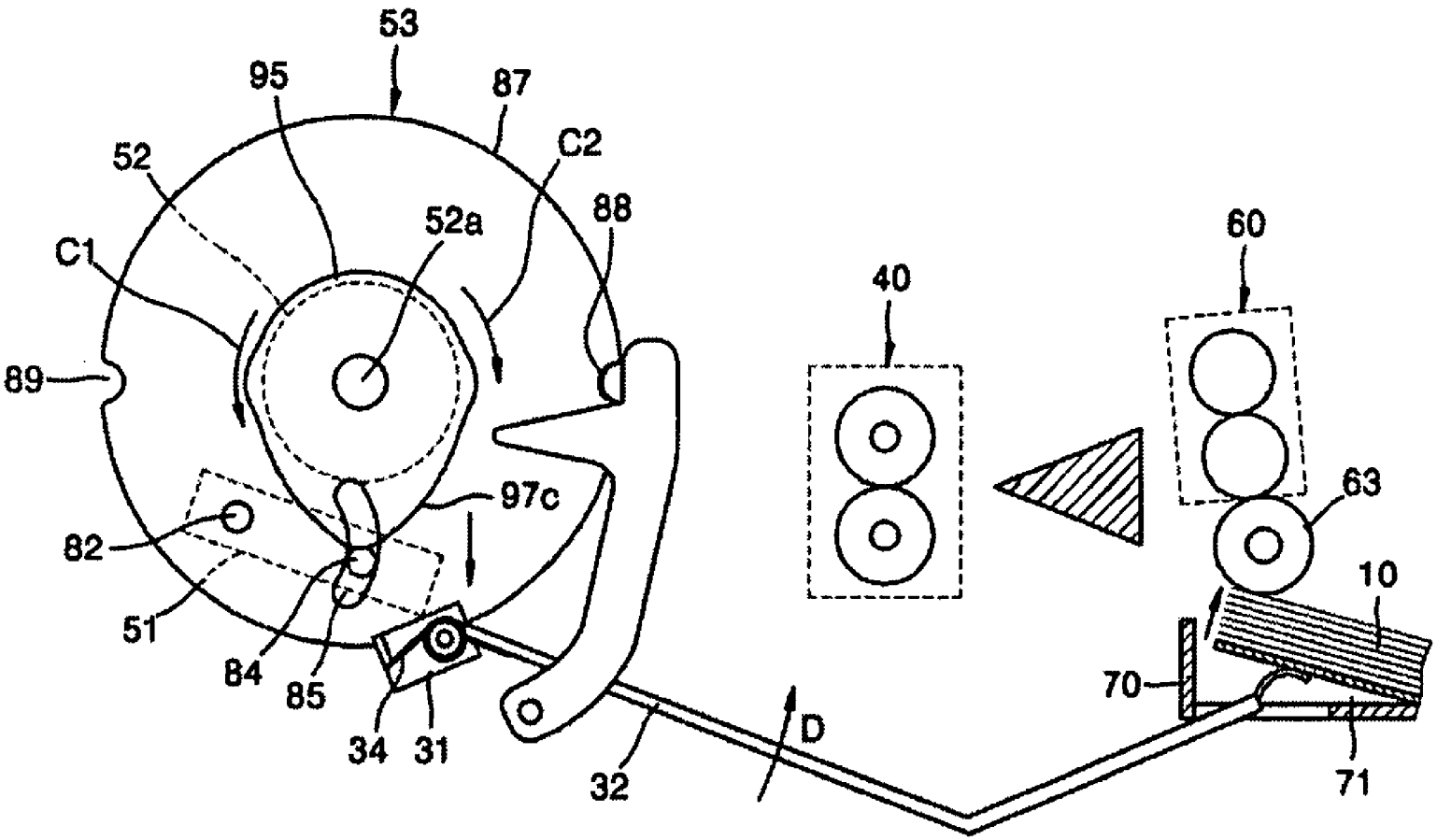

In order to pick up the medium 10, the rotating cam 95 is rotated in the direction of arrow C1, as shown in FIG. 6B, for example, by approximately 90 degrees. The support bracket 53 is locked by the locking member 20, and thus is not rotated. The third cam part 97*c* pushes the shaft 84 so that the TPH 51 is rotates to the second open position where it is separated from the platen 52 by the second gap. The TPH 51 pushes the first arm 31 to rotate the first and second arms 31 and 32 in the direction of arrow D of FIG. 5. The second arm 32 pushes the knock-up plate 71 toward the pickup roller 63. The medium 10 is stacked on the knock-up plate 71 and contacts the pickup roller 63 by the elastic force of the torsion spring 34.

The pickup roller 63 picks up the medium 10 from the cassette 70. The medium 10 enters the transfer unit 40. When the medium 10 reaches a position in which the medium 10 can be transferred by the transfer unit 40, the rotating cam 95 is rotated in the direction of arrow C2 by approximately 90 degrees. Then, the TPH 51, the first and second arms 31 and 32, and the knock-up plate 71 are restored to the positions shown in FIG. 6A.

The transfer unit 40 transfers the medium 10 between the TPH 51 and the platen 52 via the first gap. When the medium 10 is placed at the printing start position, the transfer unit 40 stops.

Figure 6C:
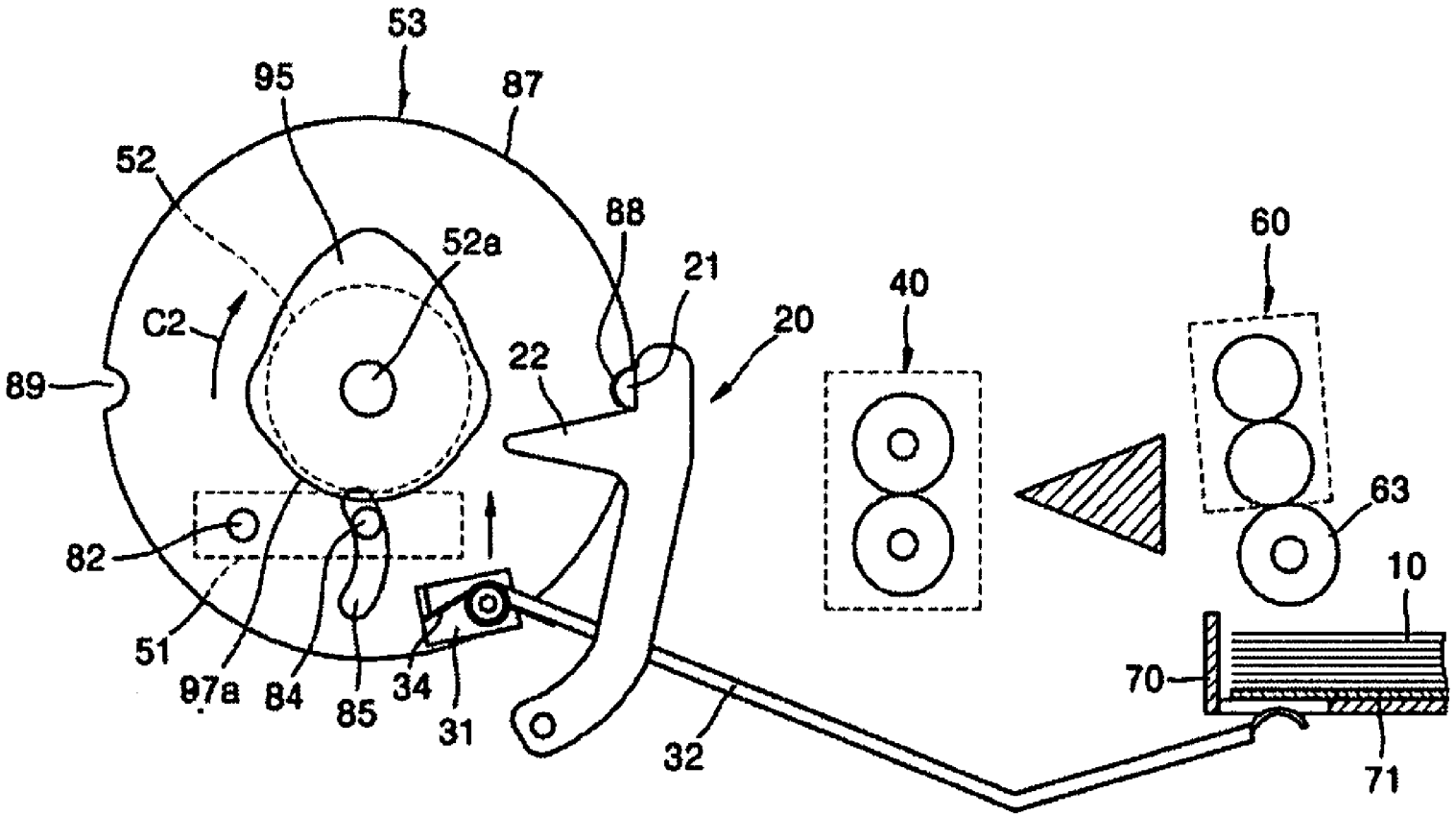

Referring to FIG. 6C, the rotating cam 95 is rotated in the direction of arrow C2. Since the protrusion of the locking member 20 is combined with the first combination groove 88, the support bracket 53 is not rotated. The shaft 84 faces the first cam part 97*a*, and the TPH 51 is rotated around the hinge hole 82 by the elastic force of the elastic member 83 so that the TPH 51 is placed at the contact position in which the medium 10 is pushed toward the platen 52. In this case, the first cam part 97*a* and the shaft 84 are separated from each other. The transfer unit 40 transfers the medium 10 in the direction of arrow A2. The TPH 51 prints an image by heating the first surface M1 of the medium 10. The discharge unit 60 temporarily discharges the medium 10 that has an image printed on the first surface M1. When printing on the first surface M1 of the medium 10 is completed, the transfer unit 40 and the discharge unit 60 stop. In this case, the medium 10 moved away from the TPH 51 and the platen 52 and engaged with the transfer unit 40 and the discharge unit 60.

Figure 6D:
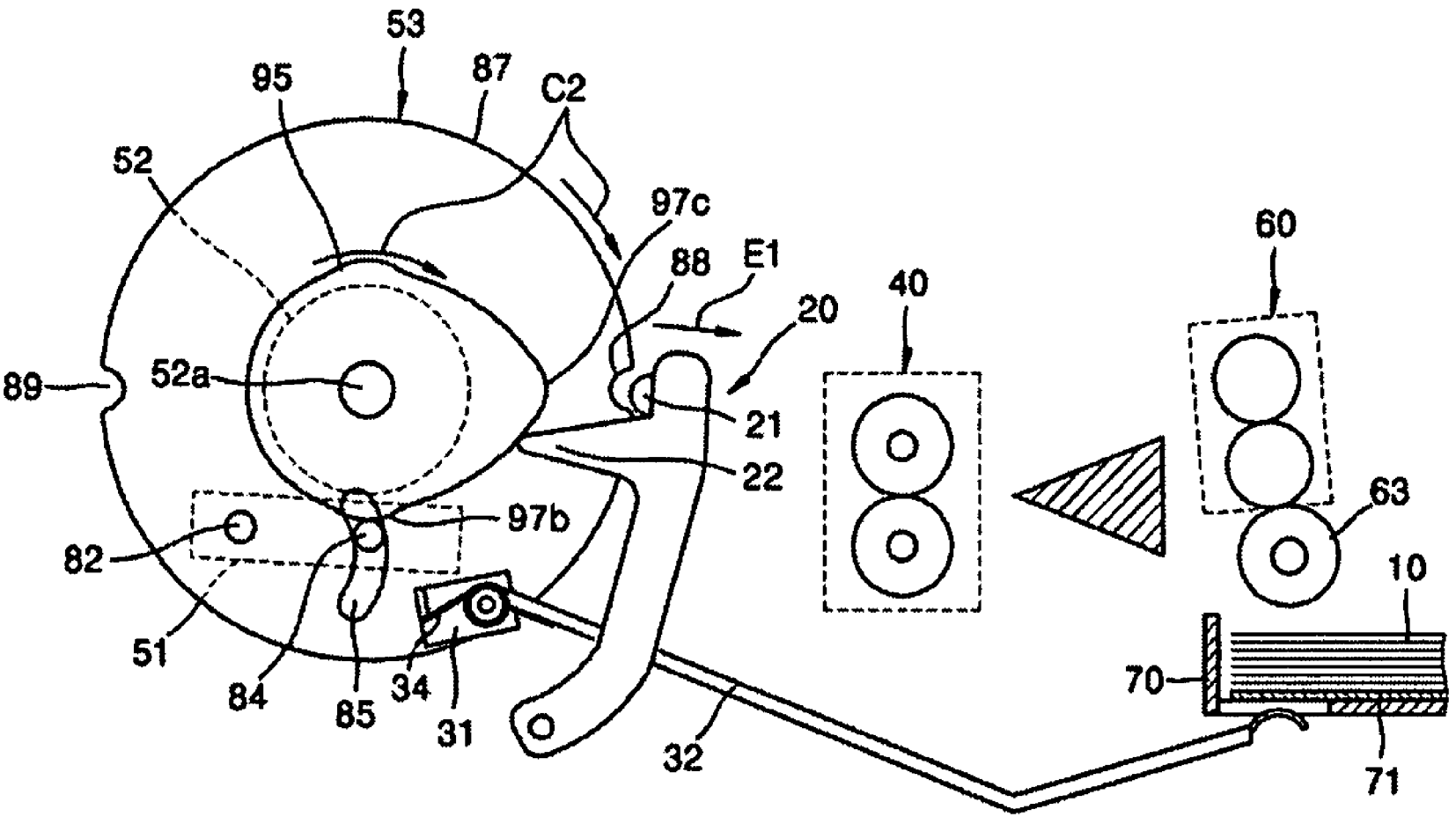
Figure 6E:
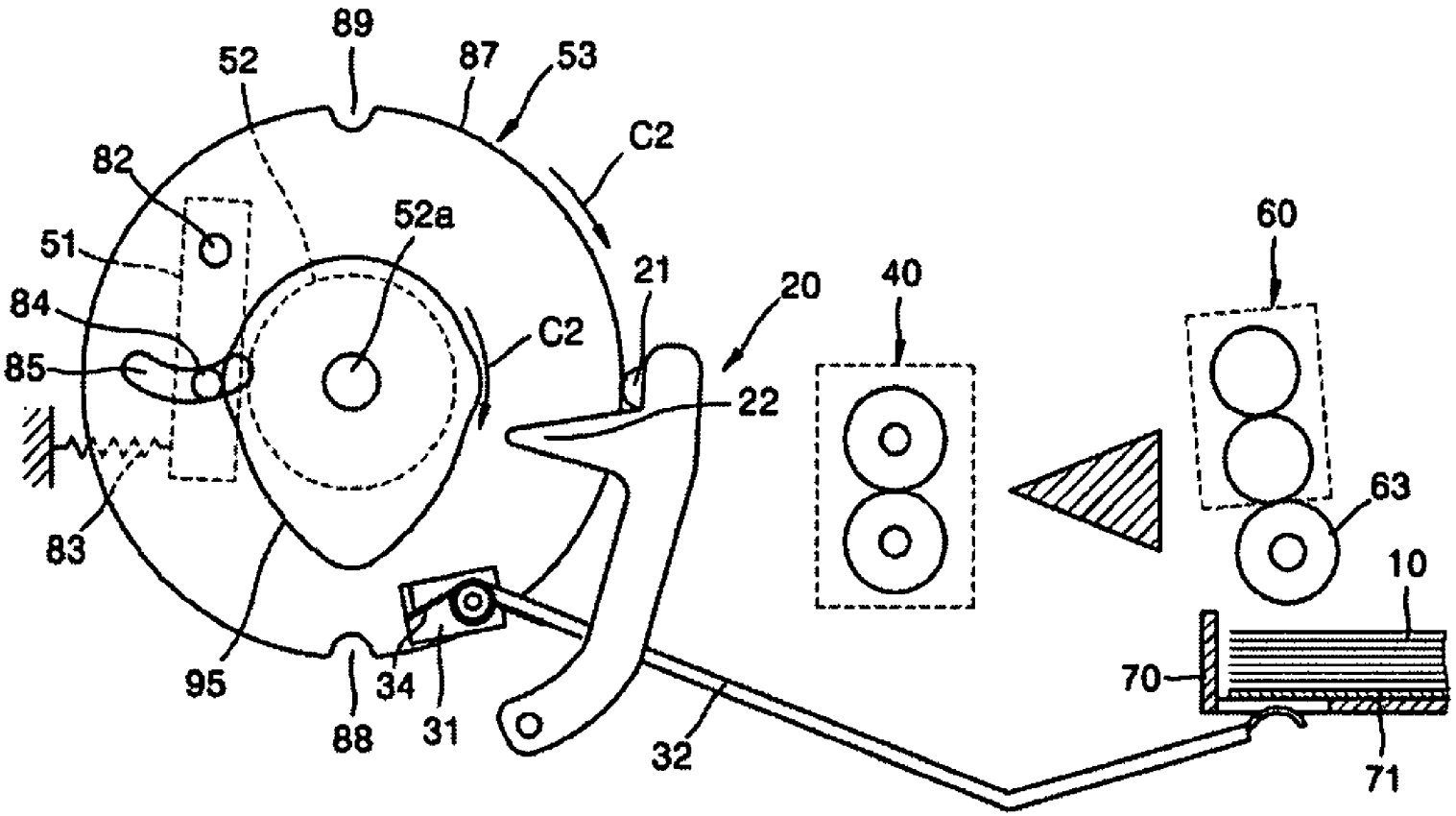
Figure 6F:
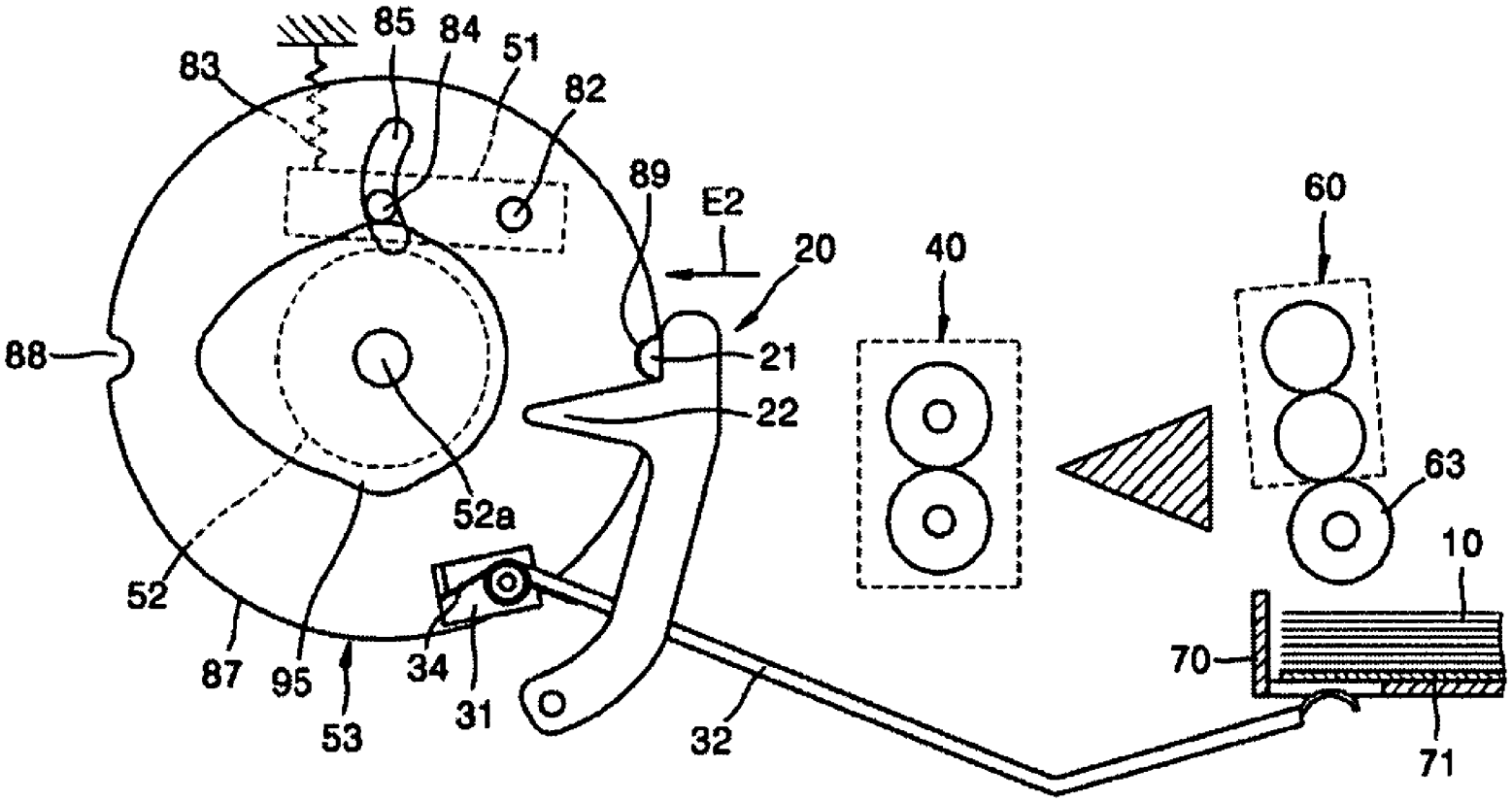

Now, an operation of moving the TPH 51 to the second position that faces the second surface M2 of the medium 10, as shown in FIG. 1B, so as to perform printing on the second surface M2 of the medium 10, is performed. Referring to FIG. 6D, when the rotating cam 95 is rotated in the direction of arrow C2, the second cam part 97*c* pushes the interference portion 22 to rotate the locking member 20 in the direction of arrow E1. Then, the protrusion 21 is released from the first combination groove 88, and the support bracket 53 freely rotates. Thus, when the rotating cam 95 is continuously rotated in the direction of arrow C2 and the second cam part 97*b* pushes the shaft 84, the TPH 51 is not separated from the platen 52 and the support bracket 53 is rotated in the direction of arrow C2, as shown in FIG. 6E. When interference between the third cam part 97*c* and the interference portion 22 stops, the locking member 20 continuously contacts the outer circumference 87 of the support bracket 53 by the elastic force of the elastic member 25. When the support bracket 53 is rotated by approximately 180 degrees, as shown in FIG. 6F, the locking member 20 is rotated in the direction of arrow E2 by the elastic force of the elastic member 25 so that the protrusion 21 is combined with the second combination groove 89 and the support bracket 53 is locked and is not rotated. The TPH 51 is locked at the second position that faces the second surface M2 of the medium 10. In addition, the TPH 51 is placed at the first open position separated from the platen 52 by the first gap.

Figure 6G:
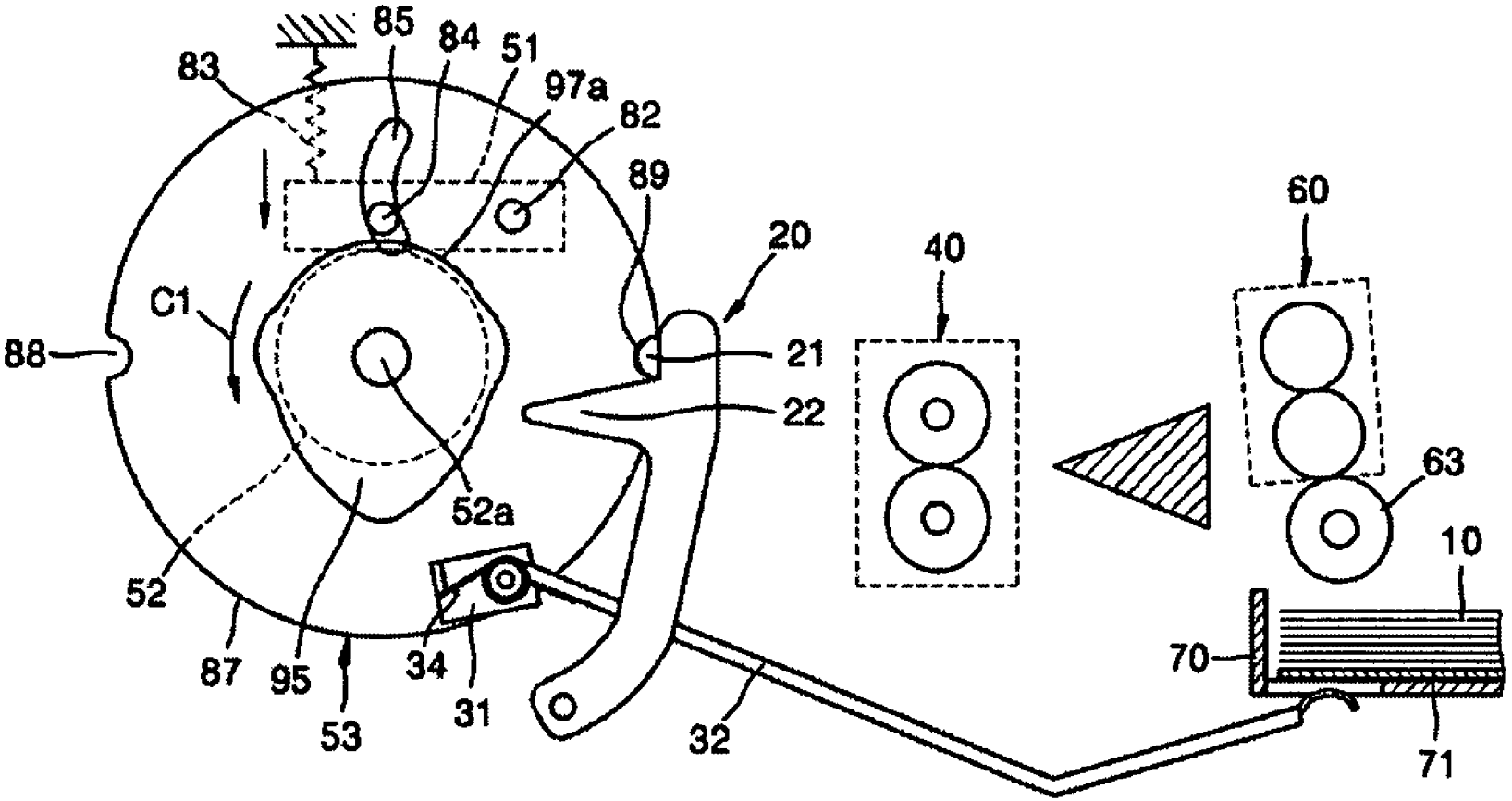

The transfer unit 40 and the discharge unit 60 transfer the medium 10 in the second direction A2. The medium 10 is transferred between the TPH 51 and the platen 52 via the first gap. When the medium 10 is placed at the printing start position, the transfer unit 40 and the discharge unit 60 stop. The TPH 51 faces the second surface M2 of the medium 10. As shown in FIG. 6G, the rotating cam 95 is rotated in the direction of arrow C1. Since the protrusion 21 of the locking member 20 is combined with the second combination groove 89, the support bracket 53 is not rotated. The shaft 84 faces the first cam part 97*a*, and the TPH 51 is rotated around the hinge hole 82 by the elastic force of the elastic member 83 and placed at the first contact position in which the medium 10 is pushed toward the platen 52. In this case, the first cam part 97*a* and the shaft 84 may be separated from each other. The transfer unit 40 transfers the medium 10 in the second direction A2. The TPH 51 prints an image by heating the second surface M2 of the medium 10. The discharge unit 60 discharges the medium 10 with an image printed on both sides.

When double-sided printing is completed, the rotating cam 95 is rotated in the direction of arrow C1. The third cam part 97*c* pushes the interference portion 22 to rotate the locking member 20 in the direction of arrow E1. Then, the protrusion 21 is released from the second combination groove 89, and the support bracket 53 freely rotates. Thus, the rotating cam 95 is continuously rotated in the direction of arrow C1, and when the second cam part 97*b* pushes the shaft 84, the TPH 51 is not separated from the platen 52 and the support bracket 53 is rotated in the direction of arrow C1. When interference between the third cam part 97*c* and the interference portion 22 stops, the locking member 20 continuously contacts the outer circumference 87 of the support bracket 53 by the elastic force of the elastic member 25. When the support bracket 53 is rotated in the direction of arrow C1 at 180 degrees, the locking member 20 is rotated by the elastic force of the elastic member 25 in the direction of arrow E2 so that the protrusion 21 is combined with the first combination groove 88 and the support bracket 53 is locked and is not rotated. The TPH 51 is restored to the first position shown in FIG. 6A.

Sensors S1 and S2 for detecting the medium 10 are shown in FIGS. 1A and 1B. For example, when the medium 10 is detected, the sensors S1 and S2 are activated, and when the medium 10 is not detected, the sensors S1 and S2 are deactivated. The printing start position can be adjusted and a jam of the medium can be detected in response to the signals of the sensors S1 and S2. Location information (first and second positions, contact position, and first and second open positions) of the TPH 51 is stored in a memory, for example, according to the printing steps during a printing operation, and a rotating angle and direction of the rotating cam 95 are calculated based on the stored position information of the TPH 51, so as to proceed the next step. The scope of the present invention is not limited to the illustrated locations or numbers of sensors. A person skilled in the art referring to the present specification can choose appropriate locations and numbers of sensors to detect a jam of the medium or position of the paper.

The TPH moving unit and the pickup unit may be applied to an image forming apparatus that is fixed at a first position in which the TPH 51 faces the first surface M1 of the medium 10. In this case, the hinge hole 82 is formed in the side plates 102 and 102*a* of the frame 100, and the hinge shaft 81 formed at the double-sided portion 51*a* of the TPH 51 is inserted into the hinge hole 82. The motor 104 rotates the rotating cam 95 so that the first, second, and third cam parts 97*a*, 97*b*, and 97*c* face the shaft 84 and the TPH 51 can move to the contact position and the first and second open positions. In addition, the pickup unit contacts the medium 10 and the pickup roller 63 so that, when the TPH 51 moves to the second open position, the pickup unit pushes the knock-up plate 71 and the pickup roller 63 picks up the medium 10 stacked on the knock-up plate 71.

As described above, in the thermal image forming apparatus according to the exemplary embodiment of the present invention, a thermal image forming apparatus to print an image on both sides of medium using one thermal printhead (TPH) can be implemented by including a position converting unit. In addition, by including a TPH moving unit, a transfer load on the medium can be reduced while the medium is transferred to a printing start position. In addition, by including a pickup unit, the structure for connecting a driving motor to a pickup roller and a discharge unit can be simplified.

While the invention has been shown and described with reference to certain embodiments thereof, it will be understood by those skilled in the art that various changes in form and details may be made therein without departing from the spirit and scope of the invention as defined by the appended claims.

What is claimed is:

1. A thermal image forming apparatus comprising:

an image forming unit including a thermal printhead and a platen that face each other and are elastically biased towards each other;

a cassette including a knock-up plate on which a medium is stacked;

a pickup roller that picks up the medium from the cassette;

a pickup unit that raises the knock-up plate in a direction in which the medium stacked on the knock-up plate contacts the pickup roller and lowers the knock-up plate in a direction in which the medium is separated from the pickup roller; and a thermal printhead moving unit that moves the thermal printhead to a contact position that contacts the platen, a first open position that is separated from the platen by a first gap, and a second open position that is separated from the platen by a second gap.

2. The apparatus of claim 1, wherein the pickup unit pushes the knock-up plate toward the pickup roller when the thermal printhead is placed at the second open position.

3. The apparatus of claim 2, wherein the pickup unit comprises:

a first arm that contacts the thermal printhead and that rotates when the thermal printhead moves to the second open position;

a second arm that is rotated by the first arm and that pushes the knock-up plate; and an elastic member that cormects the first and second arms.

4. The apparatus of claim 2, further comprising:

a transfer unit located between the pickup roller and the image forming unit, the transfer unit moving the medium in a first direction for adjusting a printing start position and a second direction for printing.

5. The apparatus of claim 4, wherein the transfer unit transfers the medium in the first direction when the thermal printhead is placed at the first open position to supply the medium between the thermal printhead and the platen and transfers the medium in the second direction when the thermal printhead is placed at the contact position.

6. The apparatus of claim 5, further comprising:

a discharge unit that discharges the medium, the discharge unit being driven by the pickup roller.

7. The apparatus of claim 2, further comprising:

a position converting unit that rotates the thermal printhead around a rotating shaft of the platen and moves the thermal printhead to first and second positions that face a first surface of the medium and a second surface opposite to the first surface, respectively.

8. The apparatus of claim 7, wherein the pickup unit pushes the knock-up plate toward the pickup roller when the thermal printhead is placed at the first position and moves to the second open position.

9. The apparatus of claim 8, further comprising:

a transfer unit located between the pickup roller and the image forming unit, the transfer unit moving the medium in a first direction for adjusting a printing start position and a second direction for printing.

10. The apparatus of claim 9, wherein the transfer unit transfers the medium in the first direction when the thermal printhead is placed at the first open position to supply the medium between the thermal printhead and the platen and transfers the medium in the second direction when the thermal printhead is placed at the contact position.

11. The apparatus of claim 10, further comprising:

a discharge unit that discharges the medium, the discharge unit being driven by the pickup roller.

12. The apparatus of claim 7, wherein the position converting unit comprises:

a support bracket rotatably installed around a rotating shaft of the platen, the thermal print head being disposed on the support bracket;

a shaft, one end of the shaft being connected to the thermal printhead and the other end of the shaft being inserted into a through hole formed in the support bracket;

a motor; and a rotating cam being rotated by the motor and pushing the shaft to rotate the support bracket.

13. The apparatus of claim 12, wherein the position converting unit further comprises:

first and second combination grooves formed in the support bracket;

a locking member which is adapted to be selectively combined with the first and second combination grooves to lock the thermal printhead at the first and second positions; and an elastic member that biases the locking member in a direction in which the locking member is combined with the first and second combination grooves, and wherein the rotating cam releases the locking member from the first and second combination grooves and rotates the support bracket.

14. The apparatus of claim 13, wherein the thermal printhead is combined with the support bracket to be rotated in a direction in which the thermal printhead either contacts or separates from the platen.

15. The apparatus of claim 14, wherein the through hole has a circular arc shape around the rotating shaft of the thermal printhead.

16. The apparatus of claim 15, wherein the thermal printhead moving unit includes first, second, and third cam parts formed in the rotating cam, and when the locking member is released from the first and second combination grooves and the rotating cam is rotated, the second and third cam parts push the shaft to rotate the thermal printhead at the first and second open positions, and the first cam part is separated from the shaft and allows the thermal printhead to contact the platen.

17. An image forming apparatus comprising:

a cassette including a knock-up plate on which a medium is stacked;

a printhead for forming an image on the medium;

a platen that faces the printhead, the medium passing between the platen and the printhead;

a pickup roller that picks up the medium from the cassette;

a printhead moving unit that moves the printhead between a contact position where the printhead contacts the platen, a first open position where the printhead is separated from the platen by a first gap, and a second open position where the printhead is separated from the platen by a second gap; and a pickup unit for raising and lowering the knock-up plate, the pickup unit comprising:

a first arm that contacts the printhead, the first arm rotating when the printhead moves to the second open position;

a second arm that is rotated by the first arm, the second arm pressing the knock-up plate to raise the knock-up plate; and an elastic member that connects the first and second arms.

18. The apparatus of claim 17, further comprising:

a transfer unit located between the pickup roller and the printhead, the transfer unit moving the medium in a first direction for adjusting a printing start position and a second direction for printing.

19. The apparatus of claim 18, wherein the transfer unit transfers the medium in the first direction when the printhead is placed at the first open position, and transfers the medium in the second direction when the printhead is placed at the contact position.

20. The apparatus of claim 19, further comprising:

a position converting unit that rotates the printhead around a rotating shaft of the platen and moves the printhead to first and second positions that face a first surface of the medium and a second surface opposite to the first surface, respectively.

21. The apparatus of claim 20, wherein the position converting unit comprises:

a support bracket rotatably installed around a rotating shaft of the platen, the thermal print head being disposed on the support bracket;

a shaft, one end of the shaft being connected to the printhead and the other end of the shaft being inserted into a through hole formed in the support bracket;

a motor; and a rotating cam being rotated by the motor and pushing the shaft to rotate the support bracket.

22. The apparatus of claim 21, wherein the position converting unit further comprises:

first and second combination grooves formed in the support bracket;

a locking member which is adapted to be selectively combined with the first and second combination grooves to lock the printhead at the first and second positions; and an elastic member that biases the locking member in a direction in which the locking member is combined with the first and second combination grooves, and wherein the rotating cam releases the locking member from the first and second combination grooves and rotates the support bracket.

* * * * *